US007859410B2

(12) United States Patent
Arguin

(10) Patent No.: US 7,859,410 B2
(45) Date of Patent: Dec. 28, 2010

(54) UNIVERSAL TRACKING ASSEMBLY

(75) Inventor: Paul R. Arguin, Andover, MA (US)

(73) Assignee: United Security Applications ID, Inc., East Windsor, NJ (US)

( * ) Notice: Subject to any disclaimer, the term of this patent is extended or adjusted under 35 U.S.C. 154(b) by 223 days.

(21) Appl. No.: 12/017,626

(22) Filed: Jan. 22, 2008

(65) Prior Publication Data

US 2008/0174437 A1 Jul. 24, 2008

Related U.S. Application Data

(60) Provisional application No. 60/871,185, filed on Jan. 24, 2007.

(51) Int. Cl.
*G08B 13/14* (2006.01)

(52) U.S. Cl. ..... 340/572.1; 340/572.3; 340/572.7; 340/572.8

(58) Field of Classification Search ... 340/572.1–572.9, 340/10.1–10.6
See application file for complete search history.

(56) References Cited

U.S. PATENT DOCUMENTS

| | | | | |
|---|---|---|---|---|
| 4,312,025 | A | 1/1982 | Boyer | |
| 5,452,520 | A | 9/1995 | Raj et al. | |
| 5,729,200 | A | 3/1998 | Copeland et al. | |
| 5,923,060 | A | 7/1999 | Gheewala | |
| 6,169,483 | B1 | 1/2001 | Ghaffari et al. | |
| 6,181,245 | B1 | 1/2001 | Copeland et al. | |
| 6,373,387 | B1 * | 4/2002 | Qiu et al. | 340/572.1 |
| 7,088,245 | B2 * | 8/2006 | Guntersdorfer et al. | 340/572.5 |
| 7,183,917 | B2 | 2/2007 | Piccoli et al. | |
| 7,345,583 | B2 * | 3/2008 | Reid et al. | 340/572.1 |
| 2004/0201479 | A1 | 10/2004 | Garber et al. | |
| 2004/0233042 | A1 | 11/2004 | Piccoli et al. | |
| 2006/0214791 | A1 | 9/2006 | Tethrake et al. | |
| 2006/0267737 | A1 | 11/2006 | Colby | |

FOREIGN PATENT DOCUMENTS

| | | |
|---|---|---|
| DE | 102004052543 | 5/2006 |
| WO | WO 01/33489 | 5/2001 |
| WO | WO 02/13156 | 2/2002 |
| WO | WO 2004/090843 | 10/2004 |
| WO | WO 2006/055653 | 5/2006 |

OTHER PUBLICATIONS

PCT International Search Report for PCT Application No. PCT/US2010/01102 dated May 17, 2010.

* cited by examiner

*Primary Examiner*—Thomas J Mullen
(74) *Attorney, Agent, or Firm*—McCormick, Paulding & Huber LLP

(57) ABSTRACT

A universal tracking assembly that is capable of supporting more than one protocol used in electronic article surveillance (EAS) labels. The universal tracking assembly includes an acousto-magnetic (AM) EAS label with a Radio Frequency (RF) EAS label. The intrinsic characteristics and properties of the components of the individual labels are utilized to enhance the overall performance and utility of the combined EAS universal tracking assembly.

13 Claims, 5 Drawing Sheets

UNIVERSAL TRACKING ASSEMBLY

CROSS-REFERENCE TO RELATED APPLICATIONS

This application claims the benefit of U.S. Provisional Application No. 60/871,185, filed Jan. 24, 2007, entitled "UNIVERSAL TRACKING SYSTEM" hereby incorporated by reference in its entirety.

FIELD OF INVENTION

The present invention relates, in general, to a universal tracking assembly, and deals more particularly with a universal tracking assembly that is capable of supporting more than one protocol used in electronic article surveillance labels.

BACKGROUND OF THE INVENTION

Bar codes are commonly utilized throughout the commercial and retail worlds in order to accurately determine the nature, cost and other vital data of an individual item. Bar codes, however, are purely passive constructs, and therefore cannot offer or transmit information themselves, instead relying upon known bar code readers to scan and interpret the information stored in the bar code itself. Moreover, the information content of bar codes is static, and cannot be changed or supplemented at will once the bar code is fabricated.

In recent years, differing electronic article surveillance (EAS) platforms/tags have been developed to address the shortcomings of known bar code systems. One such type of EAS is radio frequency identification (RFID) platforms/tags. RFIDs are small (typically) battery-less microchips that can be attached to consumer goods, cattle, vehicles and other objects to track their movement. RFID tags are normally passive, but are capable of transmitting data if prompted by a reader. The reader transmits electromagnetic waves that activate the RFID tag. The tag then transmits information via a predetermined radio frequency, or the like. This information is then captured and transmitted to a central database for suitable processing.

An RFID system typically is made up of a transponder, or tag, which is an integrated circuit (IC) connected to an antenna, which is then generally embedded into labels, a reader which emits an electromagnetic field from a connected antenna, and an enterprise system. The tag draws power from the reader's electromagnetic field to power the IC, and broadcasts a modulated signal which the reader picks up (via the antenna), decodes, and converts into digital information that the enterprise system uses.

There are two main types of RFID devices, including an inductively coupled RFID tags (otherwise known as high frequency (HF) tags). Typically, there are three main parts to an inductively coupled RFID tag:

- Silicon microprocessor—These chips vary in size depending on their purpose;
- Metal coil—Made of copper or aluminum wire that is wound into a circular pattern on the transponder, this coil acts as the tag's antenna. The tag transmits signals to the reader, with read distance determined by the size of the coil antenna. These coil antennas can operate at 13.56 MHz; and
- Encapsulating material—glass or polymer material that wraps around the chip and coil.

Inductive RFID tags are powered by the magnetic field generated by the reader. The tag's antenna picks up the magnetic energy, and the tag communicates with the reader. The tag then modulates the magnetic field in order to retrieve and transmit data back to the reader. Data is transmitted back to the reader, which directs it to the host computer and/or system.

Inductive RFID tags are very expensive on a per-unit basis, costing anywhere from $1 for passive button tags to $200 for battery-powered, read-write tags. The high cost for these tags is due to the silicon, the coil antenna and the process that is needed to wind the coil around the surface of the tag.

Another type of known RFID are capacitively coupled RFID tags. These tags do away with the metal coil and use a small amount of silicon to perform the same function as a inductively coupled tag. A capacitively coupled RFID tag also has three major parts:

- Silicon microprocessor—Motorola's BiStatix RFID tags use a silicon chip that is only 3 $mm^2$. These tags can store 96 bits of information, which would allow for trillions of unique numbers that can be assigned to products;
- Conductive carbon ink—This special ink acts as the tag's antenna. It is applied to the paper substrate through conventional printing means; and
- Paper—The silicon chip is attached to printed carbon-ink electrodes on the back of a paper label, creating a low-cost, disposable tag that can be integrated on conventional product labels.

By using conductive ink instead of metal coils, the prices of capacitively coupled tags are as low as 50 cents. These tags are also more flexible than the inductively coupled tag. Capacitively coupled tags can be bent, torn or crumpled, and can still relay data to the tag reader. In contrast to the magnetic energy that powers the inductively coupled tag, capacitively coupled tags are powered by electric fields generated by the reader. The disadvantage to this kind of tag is that it has a very limited range.

As the two preceding examples of known RFID devices indicate, there does not presently exist an industry-standard RFID protocol. With different manufacturers utilizing different RFID devices on their disparate products, large department stores, warehouses and/or shipping containers often contain a plurality of differing RFID devices.

It will therefore be readily appreciated that a large retail seller or shipper having many different products, each with different RFID devices attached thereto, may have great difficulty in matching the proper reader and associated protocol with the appropriate RFID tag, during an attempted interrogation of the RFID tag.

It is therefore necessary for retail establishments and shippers to purchase and employ multiple RFID readers and protocols, in order to ensure that every item in their inventory has been properly interrogated and categorized, as appropriate, and in accordance with the particular type of RFID device attached thereto. This undesirable duplication of readers and related machinery, and protocols, is obviously complex and costly.

Still further, known RFID devices are designed so that they may continue to communicate with extraneous readers well after the time of initial purchase. That is, known RFID devices are designed so that tracking of an item can be accomplished from the time the item leaves the factory, until it rests within the residential dwelling of its purchaser.

The very attributes, however, of known RFID devices that permit these devices to continue to operate and communicate with a reader well after the time of initial purchase, also pose problems for closely nested commercial or retail facilities.

For example, once a purchaser buys an item at a store, the RFID device will communicate with an integrated reader at the checkout. The reader will detect and interrogate the RFID device, and thereafter permit the purchaser to exit the store without setting off an alarm for shoplifting. But because of the resilient nature of the RFID devices, these devices continue to be passively 'active' even if the purchaser goes into another retail establishment, as often happens in a mall or shopping center environment. Once the original purchaser leaves the second retail store, the RFID detection equipment in the second store may awaken the RFID tag, and erroneously alert the security system of the second store. This scenario is only worsened by the differing RFID devices and protocols that currently exist in the market.

In addition to the differing RFID technologies mentioned above, other EAS technologies exist having their own operational protocols, such as acousto-magnetic (AM) EAS circuitry. Similar to the problems noted above, the problem for, e.g., manufacturer is the uncertainty of knowing which EAS technology will be employed at various stages of the manufacture, transportation and inventory of items equipped with one of the many differing EAS technologies.

It will therefore be appreciated that the primary EAS protocols in place are the acousto-magnetic (AM) type and the RF type, as discussed above. These differing EAS protocols are each independently used by various major retailers and are currently not compatible technologies. Thus, a manufacturer/distributor must maintain separate inventories of their products for the different EAS protocols incurring the added cost in doing such a practice or the manufacturer/distributor must apply both tags/labels to each of their products incurring the added cost of this alternative practice.

With the forgoing problems and concerns in mind, it is the general object of the present invention to provide a universal tracking system that is capable of harmonizing the use of differing EAS technologies/devices by integrating more than one such technology on a common susbstrate/patform. More preferably, it is the general object of the present invention to provide an integrated EAS label/tag assembly, which is compatible with both AM type and RF (including RFID) systems. The invention more preferably includes the AM type transponder which is composed of one or more amorphous alloy strips with a high magnetic permeability and a magnetic biasing strip which can be cast, die cut, painted, printed, etc. The amorphous strip(s) are packaged such that it (they) can freely resonate and is (are) sized to resonate at the desired frequency of standard AM type EAS.

SUMMARY OF THE INVENTION

It is one object of the present invention is to provide a universal tracking system.

It is another object of the present invention is to provide a universal tracking system that is capable responding to more than one EAS identification protocols.

It is another object of the present invention is to provide a universal tracking system that integrates differing EAS identification technologies upon a common platform.

It is another object of the present invention is to provide a universal tracking system that integrates differing types of RF EAS identification technologies upon a common platform.

It is another object of the present invention is to provide a universal tracking system that integrates both RF and AM EAS identification technologies upon a common platform.

It is yet another object of the present invention to provide a combined electronic article surveillance (EAS) tag/label assembly which is capable of being detected by, and of responding to, interrogation by either AM or RF technologies/protocols.

It is yet another object of the present invention to provide a combined electronic article surveillance (EAS) tag/label which is capable of utilizing at least one common element in support of the combined AM and RF technologies/protocols.

Thus, it is an object of the present invention is to make a hybrid (i.e., combined) and selectively deactivatable EAS tag/label that can be detected by both AM EAS detectors and RF EAS detectors (also including RFID). The manufacture/design of this hybrid EAS tag/label is such that the intrinsic properties of the components enhance the performance of the overall hybrid label/tag and that the manufacturing efficiencies allow for a less expensive EAS solution for the manufacturer/distributor.

These and other objectives of the present invention, and their preferred embodiments, shall become clear by consideration of the specification, claims and drawings taken as a whole.

DETAILED DESCRIPTION OF THE PREFERRED EMBODIMENTS

Known EAS assemblies, such as RFID tags, can be either active or passive. Active RFID tags include a battery, or the like, and so are capable of transmitting strong response signals even in regions where the interrogating radio frequency field is weak. Thus, an active RFID tag can be detected and transmit at a greater range than is possible with a passive RFID. Batteries, however, are limited in their operable lifetime, and add significantly to the size and cost of the tag. A passive tag derives the energy needed to power the tag from the interrogating radio frequency field, and uses that energy to transmit response codes by modulating the impedance the antenna presents to the interrogating field, thereby modulating the signal reflected back to the reader antenna. Thus, their range is more limited.

Even within known passive RFID tags, there exists significant differences in performance, including significant differences in the performance of their associated antennas and corresponding interrogation and response ranges. While one embodiment of the present invention will be hereafter described in connection with passive tags, it will be readily appreciated that the teachings of the present invention are equally applicable to active tags.

Figure 1:
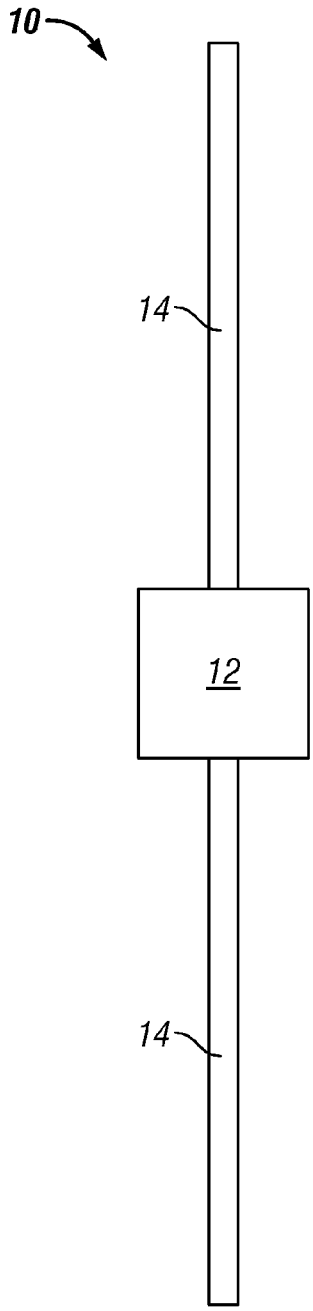
FIG. 1 (Prior Art)
FIG. 1 schematically illustrates a known RFID EAS assembly

FIG. 1 illustrates one version of a passive RFID 10, which typically includes an integrated circuit 12 and an antenna 14. The integrated circuit 12 provides the primary identification function. It includes software and circuitry to permanently (or semipermanently) store the tag identification and other desirable information, interpret and process commands received from the interrogation hardware, respond to requests for information by the interrogator, and assist the hardware in resolving conflicts resulting from multiple tags responding to interrogation simultaneously. Optionally, the integrated circuit may provide for updating the information stored in its memory (read/write) as opposed to just reading the information out (read only).

Figure 2:
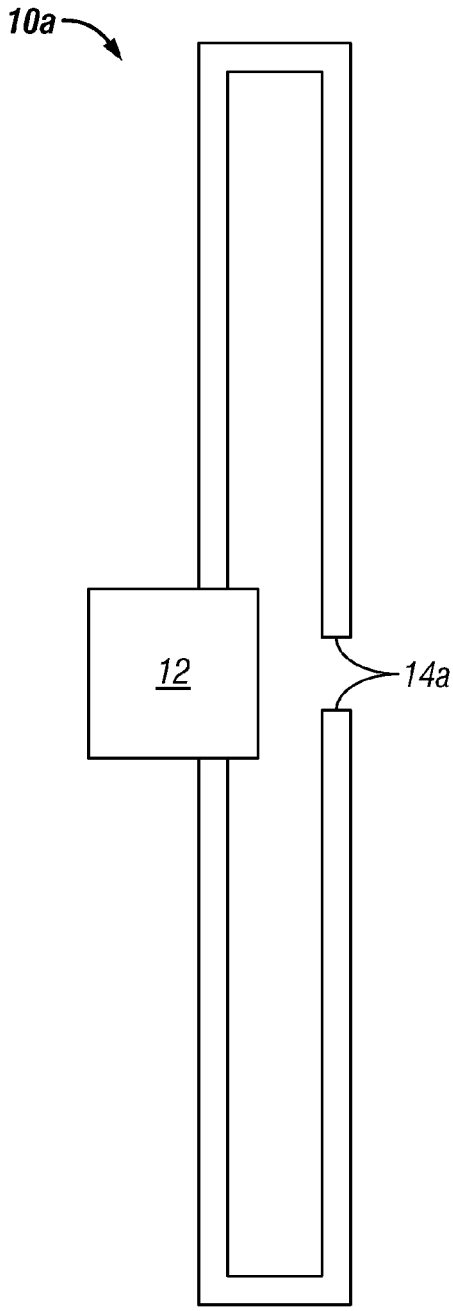
FIG. 2 (Prior Art)
FIG. 2 schematically illustrates another known RFID EAS assembly.
Figure 3:
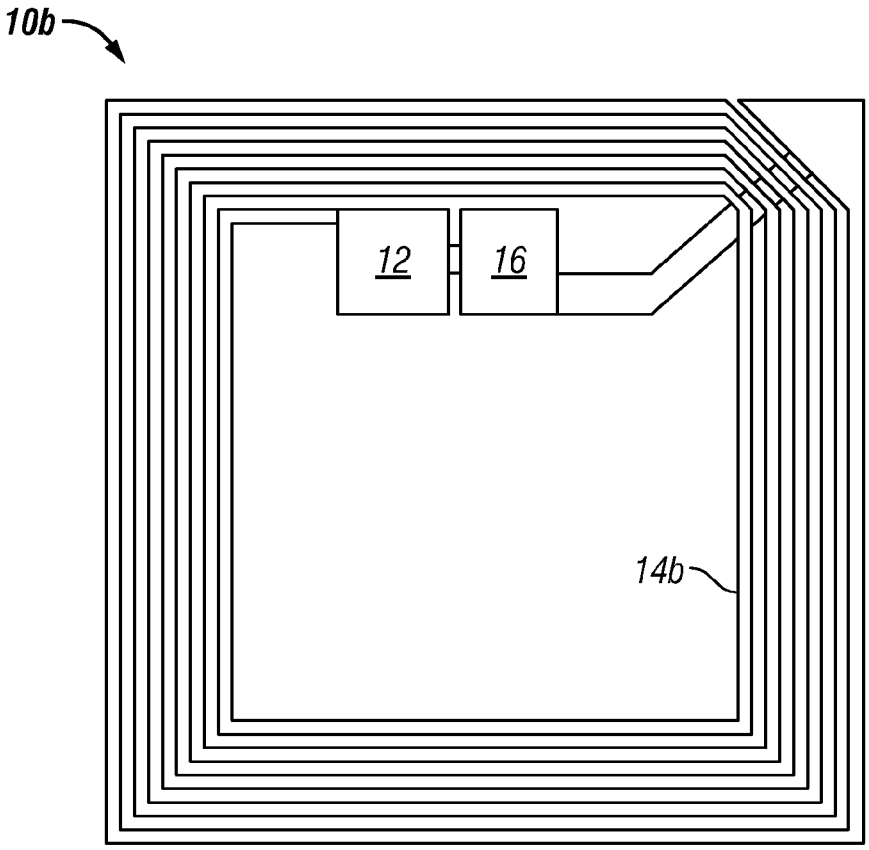
FIG. 3 (Prior Art)
FIG. 3 schematically illustrates another known RFID EAS assembly.

The antenna geometry and properties depend on the desired operating frequency of the RFID portion of the tag. For example, 2.45 GHz (or similar) RFID tags would typically include a dipole antenna, such as the linear dipole antennas 14 shown in FIG. 1, or the folded dipole antennas 14*a* shown attached to the passive RFID 10*a* in FIG. 2. A 13.56 MHz (or similar) RFID tag would use a spiral or coil antenna 14*b*, as shown in the RFID 10*b* of FIG. 3. The RFID 10*b* of FIG. 3 may also include a capacitor 16 to increase the performance of the tag. Regardless of the particular design, the antenna 14 intercepts the radio frequency energy radiated by an interrogation source. This signal energy carries both power and commands to the tag. The antenna enables the RF-responsive element to absorb energy sufficient to power the IC chip and thereby provide the response to be detected. Thus, the characteristics of the antenna must be matched to the system in which it is incorporated. In the case of tags operating in the high MHz to GHz range, the most important characteristic is the antenna length. Typically, the effective length of a dipole antenna is selected so that it is close to a half wavelength or multiple half wavelength of the interrogation signal. In the case of tags operating in the low to mid MHz region (13.56 MHz, for example) where a half wavelength antenna is impractical due to size limitations, the important characteristics are antenna inductance and the number of turns on the antenna coil. For both antenna types, good electrical conductivity is required. Typically, metals such as copper or aluminum would be used, but other conductors, including magnetic metals such as permalloy, are also acceptable.

Figure 4:
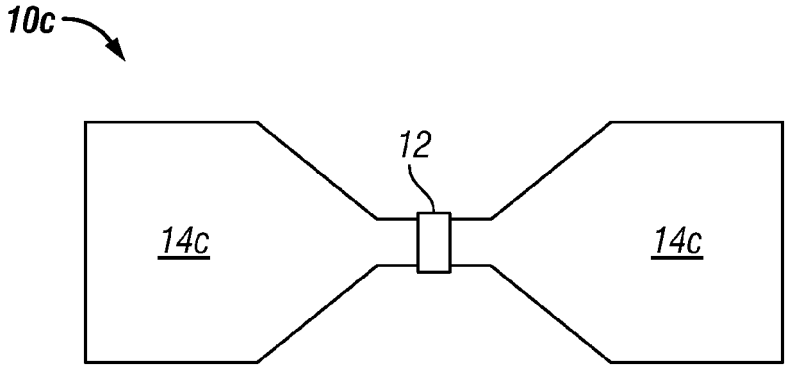
FIG. 4 (Prior Art)
FIG. 4 schematically illustrates another known RFID EAS assembly.

FIG. 4 illustrates a passive RFID tag 10*c* which utilizes a conductive ink portion 14*c* to act as the antenna for the RFID 10*c*. Although less expensive to fabricate than RFID tags that include a wound wire antenna array, the conductive ink antenna 14*c* is limited in range and power.

In sum, therefore, there exists several differing types of RFID tags, which can either incorporate a magnetically responsive element, or a RF responsive element. As will be understood, each of these differing types of tags require differing interrogation devices and protocols so as to effectively interact with each tag type. This situation is difficult for large retailers, or the like, who inevitably accept products from a vast array of manufacturers utilizing differing RFID tag types.

Figure 5:
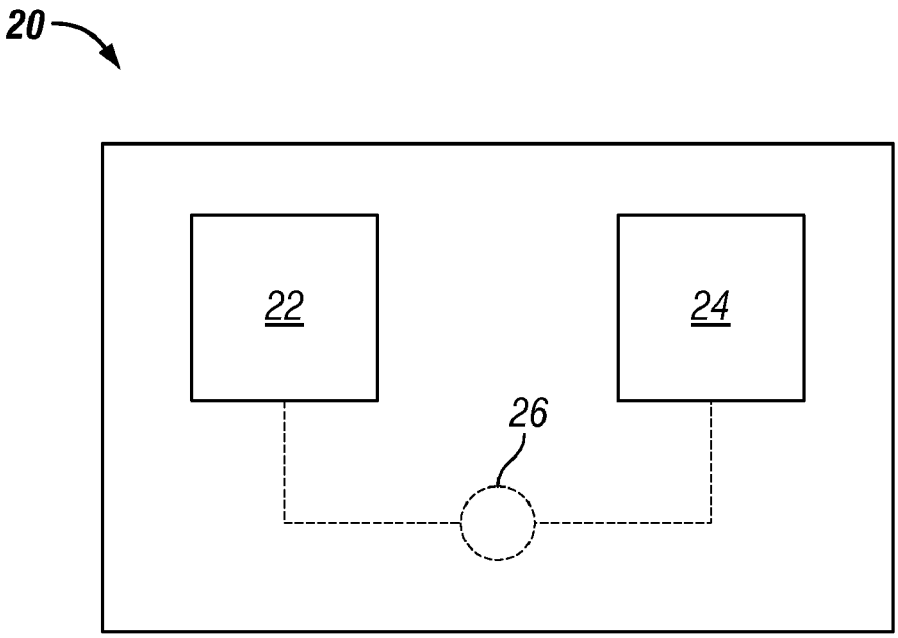
FIG. 5 schematically illustrates an integrated RFID EAS assembly according to one embodiment of the present invention.

FIG. 5 illustrates, therefore, one embodiment of the present invention. As shown in FIG. 5, a single, integrated RFID tag 20 includes both a magnetically-responsive RFID 22 and an RF-responsive RFID 24. When so coupled on a single RFID tag, these two RFID tag-types ensure that whatever type of interrogation device is employed by a user or, e.g., a retail store, the system will be able to communicate with at least one of the tags 22/24.

It is therefore an important aspect of the present invention that more than one type of RFID be integrated into a single RFID tag. By doing so the present invention ensures that regardless of the interrogation system utilized at or in any particular location, at least one of the integrated RFID tags will respond to the interrogation with the required information. Thus, a retail store need only buy a single interrogation system, without fear of not being able to communicate with those items having RFID tags of differing types.

It will be readily appreciated that the present invention is not limited to the integration of magnetically-responsive RFIDs and RF-responsive RFIDs together, and extends to the integration of RFID tags of any known, or to be discovered, type.

It is a further object of the present invention that significant elements present in one RFID tag may be universally utilized with respect to the other integrated RFID tags present on the integrated RFID tag 20. For example, should the integrated RFID tag 20 support both the RFID tags of FIGS. 3 and 4, the RFID tag of FIG. 4 could utilize the antenna 14*b* of the RFID tag in FIG. 3, thereby increasing the range of the conducive-ink RFID tag illustrated in FIG. 4.

It will be readily appreciated that the common use of a single component between differing RFID tags is not limited to the sharing of an antenna element. Indeed, the present invention equally contemplates the shared use of any component found in any RFID tag that are jointly mounted on a unitary platform.

FIG. 5 illustrates the shared use of a battery, or power supplying element, 26 with both of the RFIDs 22/24. The use of a shared or common power source 26 effectively removes the range limitations associated with certain types of RFID tags, as well as being more economically practical than providing a separate power source for each of the integrated RFIDs.

As discussed previously, large retailers, or the like, often accept merchandise from a variety of manufacturers who may be located at disparate points around the world. Each of these individual manufacturers may place an RFID tag of their choosing on the item as it is produced. This item is then transported by a shipper who may also place another RFID tag on the item, in accordance with the particular RFID system/configuration the shipper utilizes. Finally, the retailer itself may place yet another RFID tag on the item, again of its own choosing and configuration, and one which operates well with the interrogation system employed by the retailer.

In sum, any given item may have a plurality of differing RFID tags located, glued or otherwise attached thereto. Thus, while the retailer may deactivate their RFID tag placed on the item as the customer leaves the store, a problem exists when the retailer's deactivation system does not communicate with the other types of RFID tags that may also be located in or on the item.

When one or more of the additional RFID tags on a given item are not suitably deactivated, owing to their differing configurations and protocols, it is possible that the consumer may walk into another, non-affiliated store with the first item purchased, only to have the non-deactivated RFIDs set off the security system of the second store.

Figure 6:
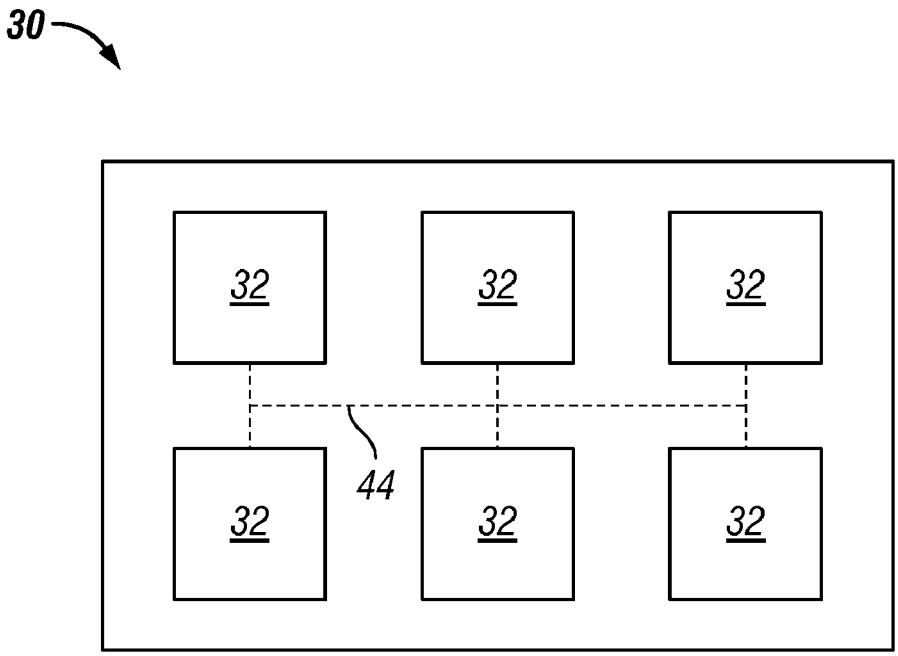
FIG. 6 schematically illustrates an integrated RFID EAS assembly according to another embodiment of the present invention.

The integrated nature of the RFID tag 20 shown in FIG. 5 removes the possibility of any such erroneous indications of shoplifting, or the like, caused by the non-deactivated RFID tags. FIG. 6 illustrates an integrated RFID tag 30, supporting an array of six differing RFID tags 32. It will be readily appreciated that there be more or less RFID tags 32 formed on the integrated RFID tag 30, without departing from the broader aspects of the present invention.

Figure 7:
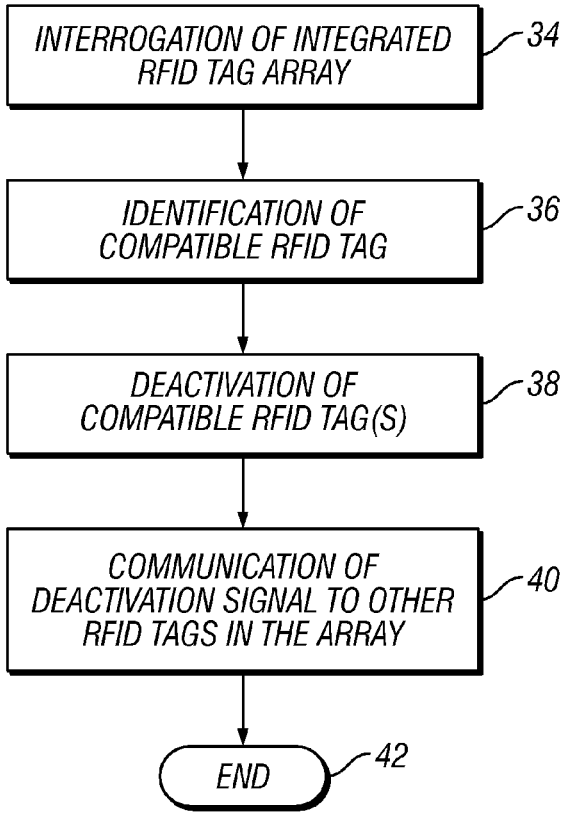
FIG. 7 illustrates a flow diagram pertaining to the integrated RFID EAS assembly of FIG. 6.

FIG. 7 is a flow diagram illustrating the operation of the integrated RFID tag 30 shown in FIG. 6. As depicted in step 34, an interrogator (such as one of the known RFID readers) is utilized to scan or interrogate the RFID tag 32. The interrogator then identifies one or more RFID tags 32 present in the array which are compatible with the technology of the interrogator, in step 36. The interrogator will then issue a command or signal to deactivate those RFID tags in the array which are compatible with the interrogator, as depicted in step 38. Following this, in step 40, the deactivation signal is communicated internally of the RFID tag 30, to the non-deactivated RF1D tags 32, thereby deactivating all of the RFID tags 32, regardless of their configuration or protocol. After the communication of the deactivation signal to the other RFID tags in the array to complete deactivation, the process ends at step 42.

It is therefore another important aspect of the present invention that the integrated nature of the RFID tag 30 enables the complete deactivation of all of the RFID tags 32 anytime when the interrogator is capable of deactivating even one of the RFID tags 32 in the array. Thus, once a consumer purchases an item, and the interrogation system employed by the retail store deactivates the store RFID, the present invention ensures that all other RFIDs (or other types of EAS assemblies, as discussed in more detail later) in the array will also be deactivated. Erroneous indication of shoplifting or the like, as the consumer moves from store to store with a previously purchased item, are thereby avoided.

The communication between the RFID tags 32 may be accomplished through a direct electrical connection, or filament, 44 (as shown in FIG. 6), or via electromagnetic coupling, such as parasitic coupling, capacitive coupling or inductive coupling.

When employing the combined (or, integrated) RFID tag 30 in accordance with the present invention, none of the existing industries or retail stores need change the protocol by which they interrogate their combined RFID tags, regardless of the technology underpinning each of the differing RFID circuitry supported thereon. That is, regardless of the interrogation or reader apparatuses utilized by the various manufacturing and retail outlets, an integrated and combined EAS tag assembly will always have at least one type of RF circuitry that is capable of communicating with the respective interrogator or reader.

Given the differing technologies currently utilized by various manufacturers of RFID EAS tags, and the anticipated continuing evolution of technology in this area, the integrated RFID tag of the present invention effectively mimics a universal standard of RFID technology and related interrogators/readers, which does not currently exist. Thus, until such a standard is accepted worldwide, the integrated RFID tag of the present invention provides a platform upon which to mask the differences between the competing RFID technologies.

Other embodiments of the present invention can be visualized by a review of the foregoing. As to the integrated RFID tag 20 shown in FIG. 5, the present invention equally contemplates that the deactivation signal communicated to either the RFID 22 or 24 is likewise communicated to the common power source 26. By changing the state of the power source, the deactivation of the RFID 22 will effectively also deactivate the RFID 24.

FIGS. 5-7 therefore exhibit related embodiments of a combined EAS assembly having a plurality of RFID technologies integrated thereon. Thus, the combined EAS assemblies shown in FIGS. 5-7 are capable of responding to interrogation by differing RFID protocols.

Figure 8:
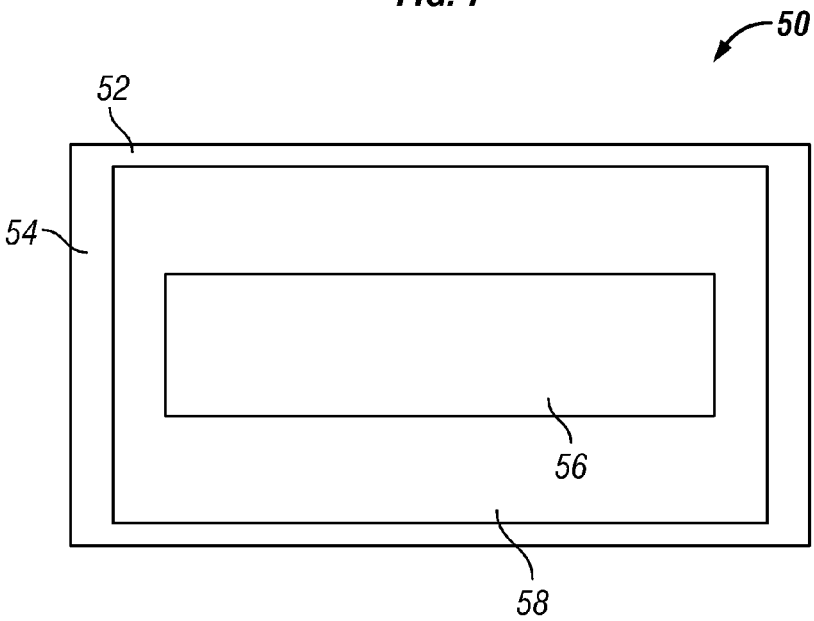
FIG. 8 illustrates a top plan view of a combined EAS tag/label assembly exhibiting integrated AM and RF components, according to a preferred embodiment of the present invention.
Figure 9:
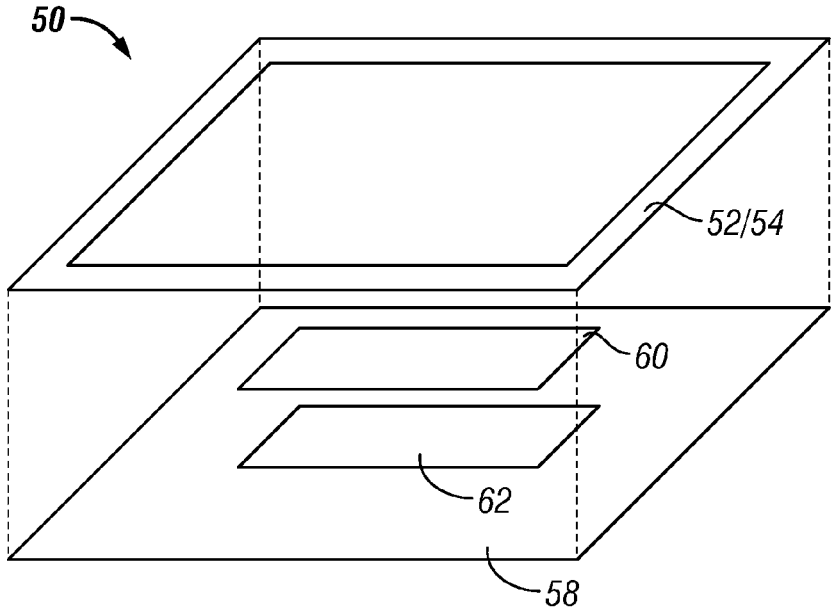
FIG. 9 illustrates a side view of the combined EAS tag/label assembly shown in FIG. 8.

In yet another, preferred, embodiment of the present invention, a combined EAS assembly 50 is shown in FIGS. 8-9. As shown in FIGS. 8-9, the combined EAS assembly 50 integrates both AM and RF components and technologies in a single, combined and universal EAS tag/label assembly.

The combined EAS tag assembly 50 includes a first portion 52 of a RF component which exhibits inductance, a second portion 54 of a RF component which exhibits capacitance, a third multi-layer portion 56 of an AM component including a resonator and a bias magnet, and a fourth portion 58 acting as the substrate and backing of the combined EAS tag 50. As shown in FIG. 9, the third multi-layer portion 56 includes an amorphous resonator 60 and a bias magnet 62.

Known RF resonators are typically configured as a LC Tank circuit, typically consisting of simply an inductor and capacitor(s). In contrast, the EAS tag assembly 50 will capture the resonant frequency of both the RF and AM components of the label and allow for a space in the center of the RF circuit to place the AM type label. The AM portion can be placed at various locations on the RF circuit, but interactions have to be accounted for and the RF portion must be tuned. Placing the AM components in the center of an open space in a RF circuit will primarily affect the inductance. Placing the AM portion in other locations could affect inductance, depending on the means of attaching or the dielectric, and certainly capacitance. Either way, once the AM portion is positioned in an inactive state, the RF portion is designed around the AM components and tuned to accommodate the interaction for any capacitance or inductance effects. This tuning will account for center frequency and the quality of the circuit.

The RF circuit components can be produced by various manufacturing methods such as die cutting, laser cutting, hot foil printing, embossing, printing with conductive inks, etc. . . . . The method of manufacture is secondary in importance to the design of the RF portion of the combined EAS tag assembly 50. The means and location of the AM circuitry portion in relation to the RF circuitry portion will effect the advantage of shielding properties. The RF label component in accordance with the embodiment shown in FIGS. 8-9 can therefore be generally formed or stamped out of a material and forming the LC tank circuit which resonates at the desired frequency. The LC tank circuitry may itself be formed by layering "foils" (or inks, etc.) with designed dielectrics to form the inductor and plate capacitors.

It is therefore another important aspect of the present invention that the RF subsystem of the EAS tag assembly/label 50 is formed in a way and with specific materials that the combined EAS tag/label assembly 50 resonates at the appropriate frequency as an AM label would.

Similar to known AM labels, the AM subsystem of the EAS tag assembly 50 will continue to include the bias magnet 62, one or more resonators 60 cut from an amorphous alloy such as MetGlas (Metglas 2826MB3 has been used, however it will be readily appreciated that the present invention is not limited by this particular alloy), and packaging to allow for magnetorestriction and resonance.

It is therefore another important aspect of the present invention that the design of the EAS tag assembly 50 allows for at least one of these AM circuit components to be part of the RF circuit. The balance/tuning of the AM subsystem is effected at least in part by the inclusion of additional resonators and shaping of the primary to not only effect the inductance and capacitance of the RF subsystem, but contribute to the resonance of the AM subsystem. These AM circuit components may also be produced by a variety of manufacturing methods and may include die cutting, printing the bias magnet, etc. It will be readily appreciated that the specific method of manufacture either the RF or AM components of the EAS tag assembly 50 is secondary to the design of the combined EAS tag assembly 50, and that the present invention is not limited by the manner in which the EAS tag assembly is manufactured.

Yet, another important aspect of the present invention is that the design of the EAS tag assembly 50 will allow for only one portion to be active at a given time. Thus, when the tag is activated for AM, it is deactivated for RF. This is coincident with the intrinsic properties of the labels themselves, as expressed:

| | AM | RF |
|---|---|---|
| Activation | Magnetize | De-magnetize |
| De-Activation | De-magnetize | Magnetize/RF Shorting |

Thus, in a preferred embodiment, the resonator component (which may be formed from Metglas or from many of the known amorphous alloys, used for the magnetorestrictive resonator) will be employed as not only the resonator in the AM subsystem, but may be a layer or a portion of a layer of the RF subsystem. The bias magnet 62 may also be a layer or a portion of a layer.

Moreover, the resonator component can also be effective for EMF shielding. As such, when a shield is placed behind the RF component, the signal from the RF is not absorbed by the package that it is trying to protect, but is directed outward toward the EAS gate which is meant to detect the signal. The shielding aspect can coexist with the actual performance of both the AM and the RF components when the RF circuit is designed and tuned to accommodate the interaction between the two. However, as stated previously, the means and location of the AM portion in relation to the RF portion will effect the advantage of shielding properties.

Figure 10:
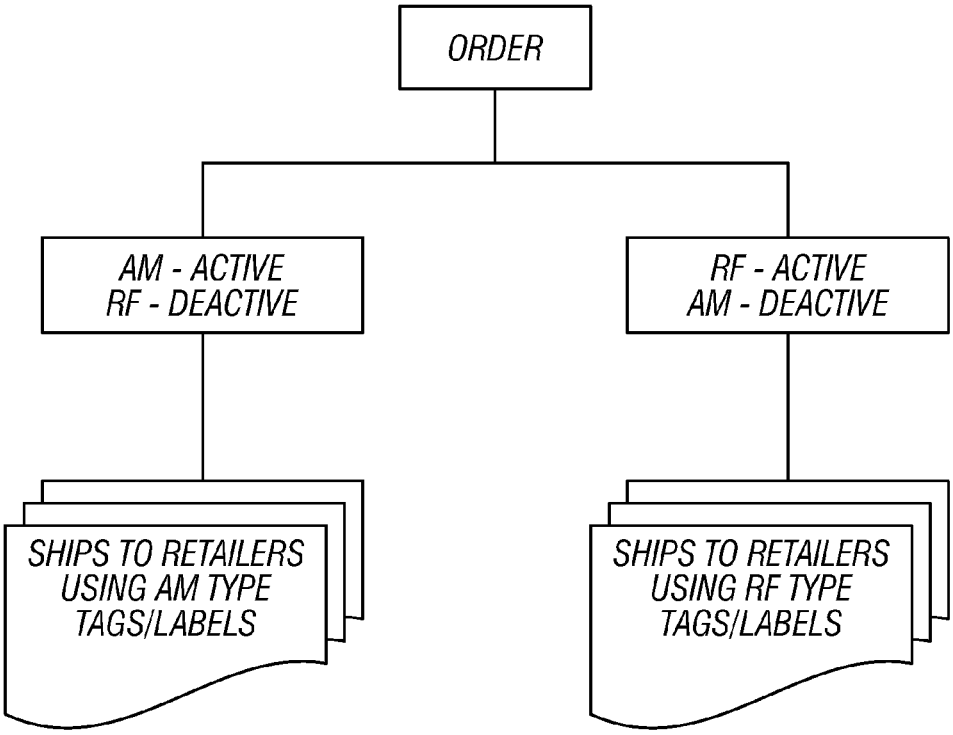
FIG. 10 illustrates a flow diagram showing the selective activation/deactivation of either the AM or RF portions of the combined EAS tag/label assembly shown in FIGS. 8-9.

It will therefore be readily appreciated that with the combined EAS tag assembly 50, a manufacturer can incorporate the label/tag 50 into a product or packaging during manufacture and maintain a single inventory. When the order for a product comes in, the products are picked and then the appropriate AM or RF component is activated/deactivated. This can be done automatically on a conveyor system or individually. A flow chart depicting the simplicity of this is shown in FIG. 10.

Thus, a preferred embodiment of the present invention provides an integrated EAS label /tag assembly 50 which is compatible with both AM type and RF (including RFID) systems. The invention includes the AM type transponder which is composed of one or more amorphous alloys strips with a high magnetic permeability and a magnetic biasing strip which can be cast, die cut, painted, printed, etc. . . . . The amorphous strip(s) are packaged such that it (they) can freely resonate and is (are) sized to resonate at the desired frequency of standard AM type EAS.

The invention also includes the RF (or RFID) component which can be manufactured by any number of known processes. The process of die cutting or laser cutting the material is the preferred method (however, any number of methods may be used), since it minimizes the steps of manufacture, amount of equipment and eases the capability of mass producing a fine tuned RF type EAS tag exhibiting the rectangular shape with open space in its center and/or for fine tuning the interaction between the components regardless of their location and RF antenna type. An open space is preferred when combining the two types of tag/labels (AM and RF) to maximize shielding effects. However, the open space is not necessarily to create a highly functional combined/universal tag, which provides the business benefit of reducing inventory and the associated costs.

Moreover, The RF subsystem of the combined EAS tag/label assembly 50 is characterized as a LC Tank Circuit where the angular frequency is equal to:

$$\omega = F_{ang} = \sqrt{\frac{1}{LC}}$$

in radians/sec ; where L is in Henries and C is in Farads;

Resonant Frequency is equal to:

$$\omega = F_{res} = \sqrt{\frac{1}{LC}}$$

in radians/sec; where L is in Henries and C is in Farads;

Measured in Hertz $$F = \frac{\omega}{2*\pi} = \frac{1}{2*\pi*\sqrt{LC}}$$

The AM subsystem of the combined EAS tag/label assembly 50 is characterized by one or more strips or ribbons of an amorphous magnetorestrictive alloy, which is magnetically biased by the placement of the bias magnet. The resonator(s) provide consistent resonant frequency when a given bias field is applied. Although it is common to have multiple resonators, the design of the present invention does not preclude the use of a single resonator or multiple arrangement. In simplistic terms, resonators of the same thickness can be accomplished as long as the length is constant and total width is approximately the same. For approximation, if a single resonator can be designed with a length of approximately 38 mm and a width of 2×, two individual resonators of the same length can be used with a width of ×, assuming consistent thickness.

The combined RF (including RFID) and AM label/tag provides the overall system with not only a less expensive means of manufacturing these labels/tags independently, but provides a potential improvement in performance and product shielding. Depending upon the position of the AM portion in relation to the RF portion, shielding may be improved. The resonators, being an amorphous alloy, are intrinsic shielding materials. Customized designs following this method allow that the RF signature will not be absorbed by the product being labeled, since the amorphous alloys used as resonators in the AM tag will shield the product and reflect the signal outward in the desired direction.

It is therefore an important aspect of the present invention that the combined EAS tags described in connection with the embodiments of FIGS. 5-10 each contain at least a first and a second circuit portions, each of which are capable of excitation (or 'interrogation', by a suitable reader/writer) by separate technological protocols. Thus, a combined EAS tag/label assembly is created which may properly communicate with any number of differing interrogation protocols, regardless of the technology protocol of the interrogator/reader.

It will also be appreciated that the disclosed embodiments as presented in connection with FIGS. 5-10 are not limiting in the nature of the EAS circuitry integrated in the combined EAS tag/label. That is, any number or differing types of EAS circuitry, in existence now or developed in the future, may be integrated onto a common substrate of an EAS tag/label, without departing from the broader aspects of the present invention. Moreover, although the present invention envisions integrating differing types of EAS circuitry onto a common substrate, each being capable of excitation/interrogation by the appropriate interrogation protocols, the combined EAS tag/label of the present invention seeks to utilize at least one common element, or component, between the differing EAS circuitry. In this manner, a reduction in the overall size and cost of the combined EAS tag/label assembly of the present invention is realized.

While the invention has been described with reference to the preferred embodiments, it will be understood by those skilled in the art that various obvious changes may be made, and equivalents may be substituted for elements thereof, without departing from the essential scope of the present invention. Therefore, it is intended that the invention not be limited to the particular embodiments disclosed, but that the invention includes all embodiments falling within the scope of the appended claims.

What is claimed is:

1. An electronic tracking label, comprising:

a first circuit portion permitting of interrogation by a first technological protocol;

a second circuit portion permitting of interrogation by a second technological protocol, said first technological protocol being different from said second technological protocol; and said first circuit portion and said second circuit portion being formed on a common substrate;

wherein said first circuit portion is a component of an inductively-coupled radio-frequency circuit; and wherein said second circuit portion is a component of a capacitively-coupled radio-frequency circuit.

2. The electronic tracking label according to claim 1, wherein:

said first circuit portion and said second circuit portion are in electrical communication with one another.

3. The electronic tracking label according to claim 1, wherein:

said first circuit portion is a component of a radio-frequency circuit; and said second circuit portion is a component of an acousto-magnetic circuit.

4. The electronic tracking label according to claim 3, wherein:

said radio-frequency circuit includes a capacitor and inductor assembly;

said acousto-magnetic circuit includes an amorphous resonator; and wherein said amorphous resonator is located between said capacitor and inductor assembly, and said substrate.

5. The electronic tracking label according to claim 1, wherein:

said first circuit portion and said second circuit portion share at least one common element.

6. The electronic tracking label according to claim 5, wherein:

said at least one common element is a power source.

7. A method for forming a universal tracking label, comprising the steps of:

forming a first circuit portion on a substrate, said first circuit portion being capable of excitation by a first interrogation protocol;

forming a second circuit portion on said substrate, said second circuit portion being capable of excitation by a second interrogation protocol, wherein said first interrogation protocol is different from said second interrogation protocol;

configuring a component of said first circuit portion to be an inductively-coupled radio-frequency circuit; and configuring a component of said second circuit portion to be a capacitively-coupled radio-frequency circuit.

8. The method for forming a universal tracking label according to claim 7, further comprising the steps of:

configuring a component of said first circuit portion to be a radio-frequency circuit; and configuring a component of said second circuit portion to be an acousto- magnetic circuit.

9. The method for forming a universal tracking label according to claim 8, further comprising the steps of:

configuring said radio-frequency circuit to include a capacitor and inductor assembly;

configuring said acousto-magnetic circuit to include an amorphous resonator; and locating said amorphous resonator between said capacitor and inductor assembly, and said substrate.

10. The method for forming a universal tracking label according to claim 7, further comprising the steps of:

configuring said first circuit portion and said second circuit portion to share at least one common element.

11. A method of transmitting signals between identification assemblies having differing operating protocols, said method comprising the steps of:

fixing a first identification circuitry on a substrate to thereby form a first identification assembly, said first identification assembly having a first operating technology;

fixing a second identification circuitry on said substrate to thereby form a second identification assembly, said second identification assembly having a second operating technology wherein said first operating technology is different from said second operating technology;

electrically coupling said first and said second identification assemblies;

interrogating one of said first and said second identification assemblies, thereby causing said one of said first and said second identification assemblies to take an action in response thereto; and communicating a signal to the other of said first and said second identification assemblies in dependence thereon.

12. An electronic tracking label, comprising:

a first circuit portion permitting of interrogation by a first technological protocol;

a second circuit portion permitting of interrogation by a second technological protocol, said first technological protocol being different from said second technological protocol; and said first circuit portion and said second circuit portion being formed on a common substrate;

wherein said first circuit portion is a component of a radio-frequency circuit, said radio frequency circuit including a capacitor and inductor assembly;

wherein said second circuit portion is a component of an acousto-magnetic circuit, said acousto-magnetic circuit including an amorphous resonator; and wherein said amorphous resonator is located between said capacitor and inductor assembly, and said substrate.

13. A method for forming a universal tracking label, comprising the steps of:

forming a first circuit portion on a substrate, said first circuit portion being capable of excitation by a first interrogation protocol;

forming a second circuit portion on said substrate, said second circuit portion being capable of excitation by a second interrogation protocol, wherein said first interrogation protocol is different from said second interrogation protocol;

configuring a component of said first circuit portion to be a radio-frequency circuit;

configuring a component of said second circuit portion to be an acousto-magnetic circuit;

configuring said radio-frequency circuit to include a capacitor and inductor assembly;

configuring said acousto-magnetic circuit to include an amorphous resonator; and locating said amorphous resonator between said capacitor and inductor assembly, and said substrate.

* * * * *